US006631587B2

(12) United States Patent
Lynch

(10) Patent No.: US 6,631,587 B2
(45) Date of Patent: Oct. 14, 2003

(54) SUPPLEMENTAL GUTTER SUPPORT BRACKET

(76) Inventor: Kenneth Lynch, 8810 N. University, Peoria, IL (US) 61615

( * ) Notice: Subject to any disclaimer, the term of this patent is extended or adjusted under 35 U.S.C. 154(b) by 0 days.

(21) Appl. No.: 09/873,168

(22) Filed: Sep. 28, 2001

(65) Prior Publication Data

US 2003/0061770 A1 Apr. 3, 2003

(51) Int. Cl.[7] ..... E04D 13/00

(52) U.S. Cl. ..... 52/11; 52/12; 248/48.1; 248/48.2

(58) Field of Search ..... 52/11, 12, 13, 52/14, 15, 16; 248/48.2; 11/48.1

(56) References Cited

U.S. PATENT DOCUMENTS

| | | | | | |
|---|---|---|---|---|---|
| 148,952 | A | * | 3/1874 | Hess | 248/48.2 |
| 2,710,159 | A | * | 6/1955 | Gordon | 248/48.2 |
| 2,928,634 | A | * | 3/1960 | Bender | 248/48.2 |
| 3,053,491 | A | * | 9/1962 | Ramser | 248/48.2 |
| 3,239,172 | A | * | 3/1966 | Chamlers | 248/48.2 |
| 3,296,749 | A | * | 1/1967 | Cotter | 52/11 |
| 3,333,803 | A | * | 8/1967 | Landis | 248/48.2 |
| 3,737,127 | A | * | 6/1973 | Maloney et al. | 235/58 P |
| 3,752,428 | A | * | 8/1973 | Trostle et al. | 248/48.2 |
| 4,169,570 | A | * | 10/1979 | Morin | 248/48.2 |
| 4,294,422 | A | * | 10/1981 | Odekirk | 248/216.1 |
| 4,314,683 | A | * | 2/1982 | Cunning | 248/48.2 |
| 4,910,926 | A | * | 3/1990 | Paulsson | 52/11 |
| 5,098,045 | A | * | 3/1992 | Pepper | 248/48.2 |
| 5,388,377 | A | * | 2/1995 | Faulkner | 52/11 |
| 6,209,826 | B1 | * | 4/2001 | Pratt, Jr. | 248/231.9 |
| 6,254,039 | B1 | * | 7/2001 | Zimmerman | 248/48.1 |

* cited by examiner

*Primary Examiner*—Jeanette Chapman
(74) *Attorney, Agent, or Firm*—Anthony A. Davis

(57) ABSTRACT

A new supplemental gutter support bracket designed to be incorporated upon a conventional gutter bracket by being installed upon and secured to the existing gutter bracket as well as the eave to which the gutter bracket is attached. When installed in conjunction with a conventional gutter bracket the supplemental gutter support bracket provides added strength to the gutter support system by triangulating the mounting points of the conventional gutter bracket with the mounting points of the supplemental gutter support bracket. The supplemental gutter support bracket also requires no additional mounting points to the eave or gutter while remaining invisible to the viewer on the ground after installation. The supplemental gutter support bracket also does not protrude or hang down into the gutter channel thereby impeding the flow of larger debris into the preselected gutter downspout.

7 Claims, 7 Drawing Sheets

SUPPLEMENTAL GUTTER SUPPORT BRACKET

BACKGROUND OF THE INVENTION

1. Field of the Invention

The present invention relates to the various methodologies used in the building trades to attach gutters to eaves of buildings, and more particularly to a supplemental gutter support bracket which provides added strength to the gutter attachment system when used in conjunction with a conventional gutter bracket.

2. Description of the Prior Art

It is well known that safe and effective control of roof run-off must be carefully planned for during the construction of a building. Ordinarily in this regard, gutters are provided at the eaves of the building to capture water flowing down the roof and to direct it in a controlled manner to a preselected outflow location. Modern day gutters may be of aluminum, galvanized steel or plastic construction, and are generally of a cross-section characterized by a flat rear wall, a flat bottom, and a convexly curved (as seen from the exterior) front wall which terminates at its upper end with a U-shaped front wall which terminates at its upper end with a U-shaped member. One or more downspouts are provided which interface with the gutter to channel water to the ground at one or more preselected outflow locations.

There are several ways of attaching gutters to the eaves of a building. Commonly, gutter spikes are used to nail the gutter to a building structure behind the rear wall of the gutter. The gutter spike pierces the rear wall, and then penetrates into a building structure, usually a solid wooden board. Another approach is to utilize a conventional gutter bracket to hold the gutter to the eaves. A conventional gutter bracket has a main body which is sized to span the distance between the rear wall and the U-shaped member of the gutter. At one end of the main body is located a clip which slips over the rear wall of the gutter, and the other end of the main body is provided with a nose which is dimensioned to snugly seat into the U-shaped member. The clip is provided with an aperture. A spiral gutter bracket nail is typically used to hold the gutter to the eaves, whereby the nail is driven through the rear wall of the gutter at the clip aperture and into the building structure. Another variation of the conventional gutter bracket does not contain a clip at one end. Instead, the clip is replaced by a single upright surface.

While these two methods of installing gutters are quite common, each has one or more disadvantages. In the case of the gutter spike method, the spike head is visible from the outside and the support derived from the spike head alone may not be sufficient. When utilizing the conventional gutter bracket method there are no visible spike heads being visible from the outside in that the gutter bracket is hidden from view; but, the gutter bracket may slip out of alignment with the gutter as it's being nailed and the gutter may be able to wobble on the gutter nail during high wind because a very long lever arm extends between the rear wall and the U-shaped member of the gutter. Also, due to the weight of the gutter and the span of the conventional gutter bracket, the gutter system will begin to sag over time and eventually become detached or in operable for its intended purpose.

In order to improve upon the aforementioned problems associated with the spike and the conventional gutter bracket methods, there have been various gutter support brackets which appear to solve at least some of the aforementioned problems associated with said attachment methods. Support brackets in the prior art generally consist of devices which either act as replacements for conventional gutter brackets, require additional attachment points to the gutter or eave, impede the flow of debris and materials within the gutter, or are at least partially visible from the ground after installation. Those support brackets which are not visible from the ground upon installation typically hang down into the gutter channel and tend to impede the flow of large debris down to the preselected outflow locations thereby eventually clogging said channel and causing the run-off to overflow the gutter channel thereby rendering the gutter ineffective for its intended purpose until such time as the clog can be manually remediated.

Accordingly, what is needed in the prior art is a supplemental gutter bracket that may be optionally utilized with a conventional type gutter bracket which provides additional strength while requiring no additional contact points with the eave or gutter, remains out of sight to the viewer after installation, and which does not impede the flow of debris within the gutter channel to the pre-selected gutter downspout.

SUMMARY OF THE INVENTION

The present invention is a supplemental gutter bracket which works in conjunction with a conventional gutter bracket to provide improved support while remaining out of sight to the viewer after installation which does not impede the flow of debris within the gutter channel to the preselected gutter downspout.

The supplemental gutter bracket according to the present invention is comprised of a bracket body which is further defined as having a tab for engagement with a conventional gutter bracket, an elbow portion, a rear attachment flange, and a penetrating means which extends through: the supplemental gutter bracket, the aligned aperture at the rear portion of the conventional gutter bracket, through the gutter, and into the eave of the building to which the gutter is to be attached.

When installed upon a conventional gutter bracket, the supplemental gutter bracket provides added strength thereto by triangulating the attachment points of the conventional gutter bracket with those of the supplemental gutter bracket. The installed supplemental gutter bracket is also generally not visible by the viewer standing on the ground after the gutter is installed upon the eave of the building. The supplemental gutter bracket also does not hand down or protrude into the gutter channel thereby impeding the flow of debris to the pre-selected downspout or outflow locations.

Accordingly, it is an object of the present invention to provide an inexpensive supplemental gutter support bracket which adds strength when utilized in conjunction with a conventional gutter bracket.

It is an additional object of the present invention to provide a supplemental gutter support bracket which is not visible by the viewer standing on the ground after the gutter is installed upon the eave of the building.

It is yet another object of the present invention to provide a supplemental gutter support bracket which does not protrude into the gutter channel thereby impeding the flow of debris to the pre-selected downspout.

It is a further object of the present invention to provide a supplemental gutter support bracket which is useful in the re-securing of an existing conventional gutter brackets which have become loose from the eave of the building to which they were attached. This is accomplished without forming a new nail hole within the eave.

It is still another object of the present invention to provide a encased fastener to expediate the installation of the supplemental gutter support bracket.

These, and additional objects, advantages, features and benefits of the present invention will become apparent from the following specification.

DETAILED DESCRIPTION OF THE PREFERRED EMBODIMENT

Referring now to FIGS. 1, 2, 3, 4, 5, 6, 7, 8 and 9, the structure and function of the supplemental gutter support bracket 1 according to the present invention will be elucidated using the preferred example depicted therein.

Figure 4:
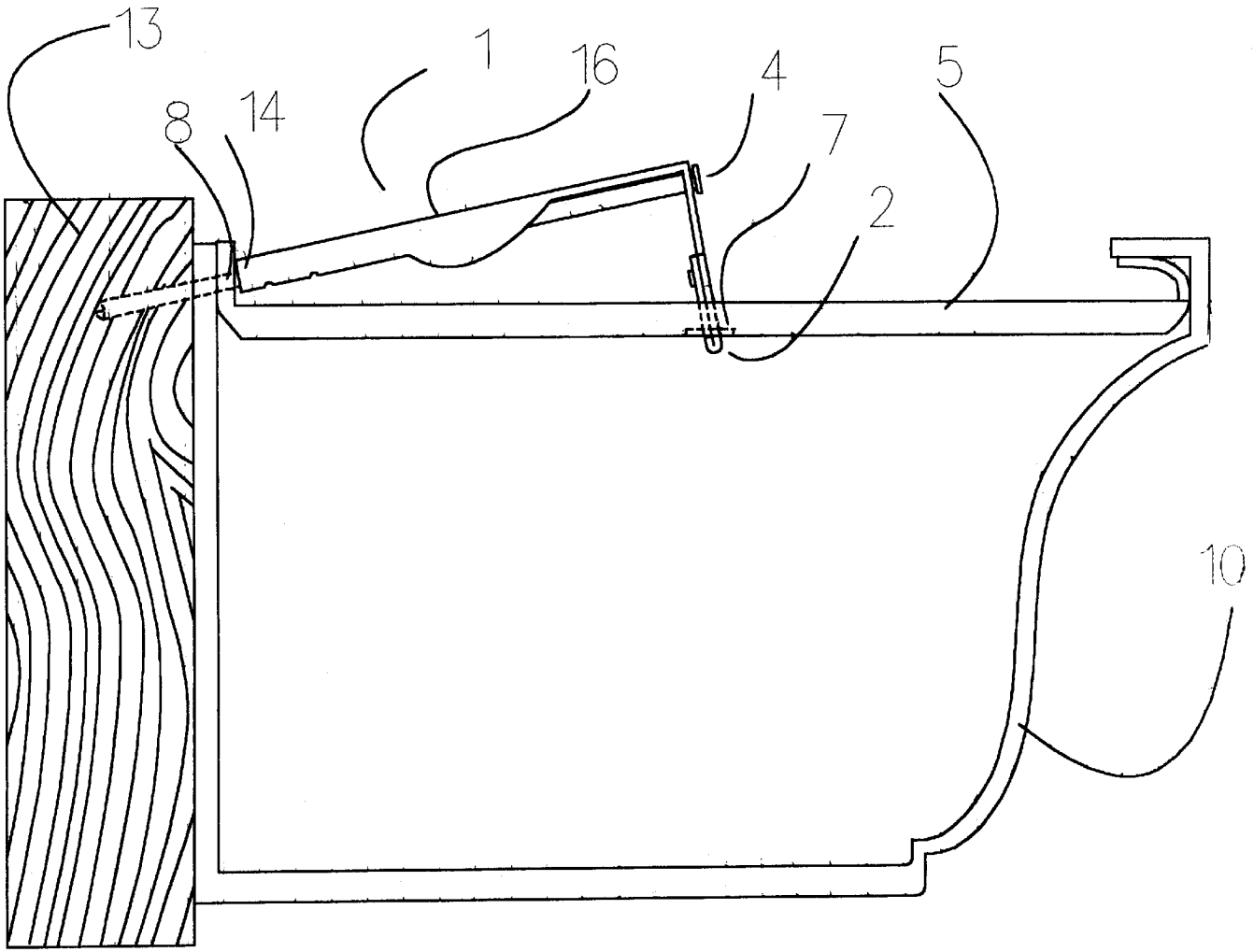
FIG. 4 is a side view of the supplemental gutter support bracket as installed upon a conventional gutter bracket which is attached to a gutter which is attached to an eave.
Figure 5:
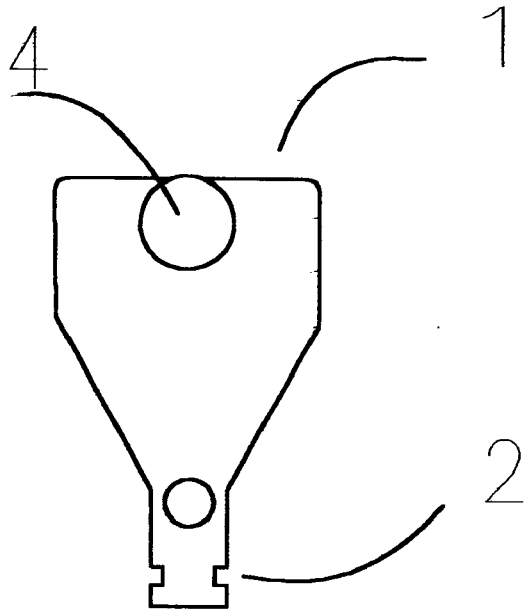
FIG. 5 is a rear view of the supplemental gutter support bracket.
Figure 6:
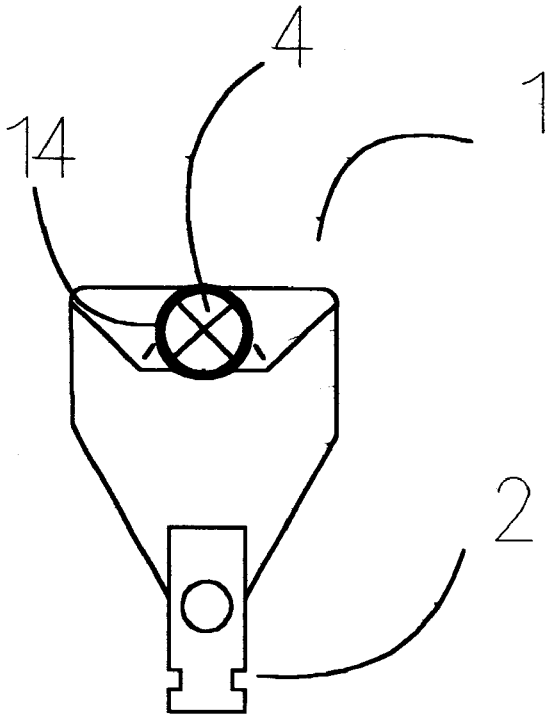
FIG. 6 is a frontal view of the supplemental gutter support bracket.

The supplemental gutter support bracket 1 is preferably constructed of a rigid material such as aluminum, galvanized steel, or plastic of such strength which would provide adequate additional support to a conventional gutter bracket 5 given the weight of the gutter 10 to be attached to the building's eave 13, see FIG. 4.

Now referring to FIGS. 1, 3, 5, 6, 7, 8, and 9, the following is a description of the current invention as well as the process for installing said supplemental gutter support bracket 1. The supplemental gutter support bracket 1 is generally defined as an "L" shaped member which is further defined as having a locking tab member 2 (see FIGS. 5 and 6) on one end and a flanged portion 14 on the other end. At the elbow 3 of the supplemental gutter support bracket 1 a fastener 4 is displaced within the aperture 15 within the elbow 3 and extends through the flange portion 14. Another preferred embodiment of the locking tab member 2 is a straight tab as demonstrated in FIGS. 7, 8, and 9. The locking tab member 2 can be configured in any number of ways where it engages the locking tab member slot 7 in a manner which prohibits downward gravitational movement of the conventional gutter bracket 5 in relation to the eave of the building 13 (by holding the gutter 10 in position as originally installed).

Now referring to FIGS. 1, 2, 3, and 4. Although not necessary in order to practice the present invention, one preferred embodiment of the present invention is to provide a fastener 4 which is pre-installed or encased within the supplemental gutter support bracket 1. This pre-installation is accomplished by inserting and crimping the fastener 4 within the casing 16 of the supplemental gutter support bracket 1 during the formation or stamping process of said casing 16. The crimping process applies only enough pressure upon the fastener 4 to confine it within said casing 16 in approximately the position shown in FIG. 1. While not only allowing the supplemental gutter support bracket 1 and the fastener 4 to be installed as a single unitary member upon a conventional gutter bracket 5 in a simple and expedient manner, the containment of the fastener 4 also allows the fastener 4 to be pulled only slightly backward through its displaced path in the casing 16 until the end tip of the fastener 4 is snap fitted into the conventional gutter bracket aperture 8. Once again, the snap fitting of the fastener 4 in connection with a supplemental gutter support bracket 1 allows the supplemental gutter support bracket 1 (which contains the pre-installed fastener 4) and the conventional gutter bracket 5 to be installed as a unitary member into a gutter 10 and upon an eave 13. During installation the fastener 4 can be extended through the casing 16 of the supplemental gutter support bracket 1 and conventional gutter bracket aperture 8 by delivering one or more blows from a hammer or like device to the head of the fastener 4 thereby dislodging it from the pre-installed position and into the eave 13 and thereby securing the gutter support bracket 1/conventional gutter bracket 5 assembly and the gutter 10 to the eave 13.

Figure 1:
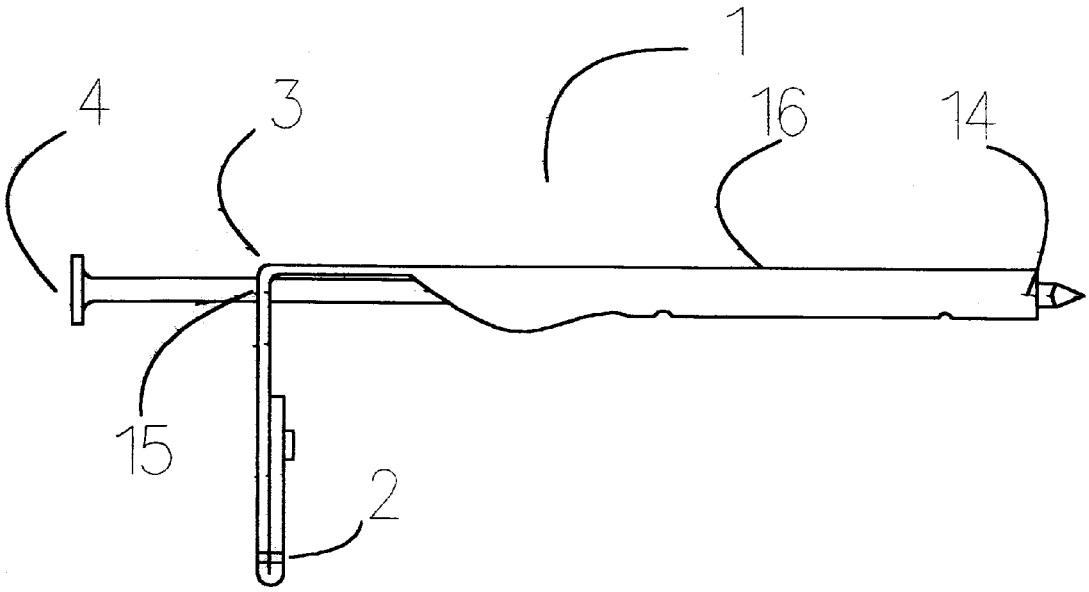
FIG. 1 is a side view of the supplemental gutter support bracket.
Figure 2:
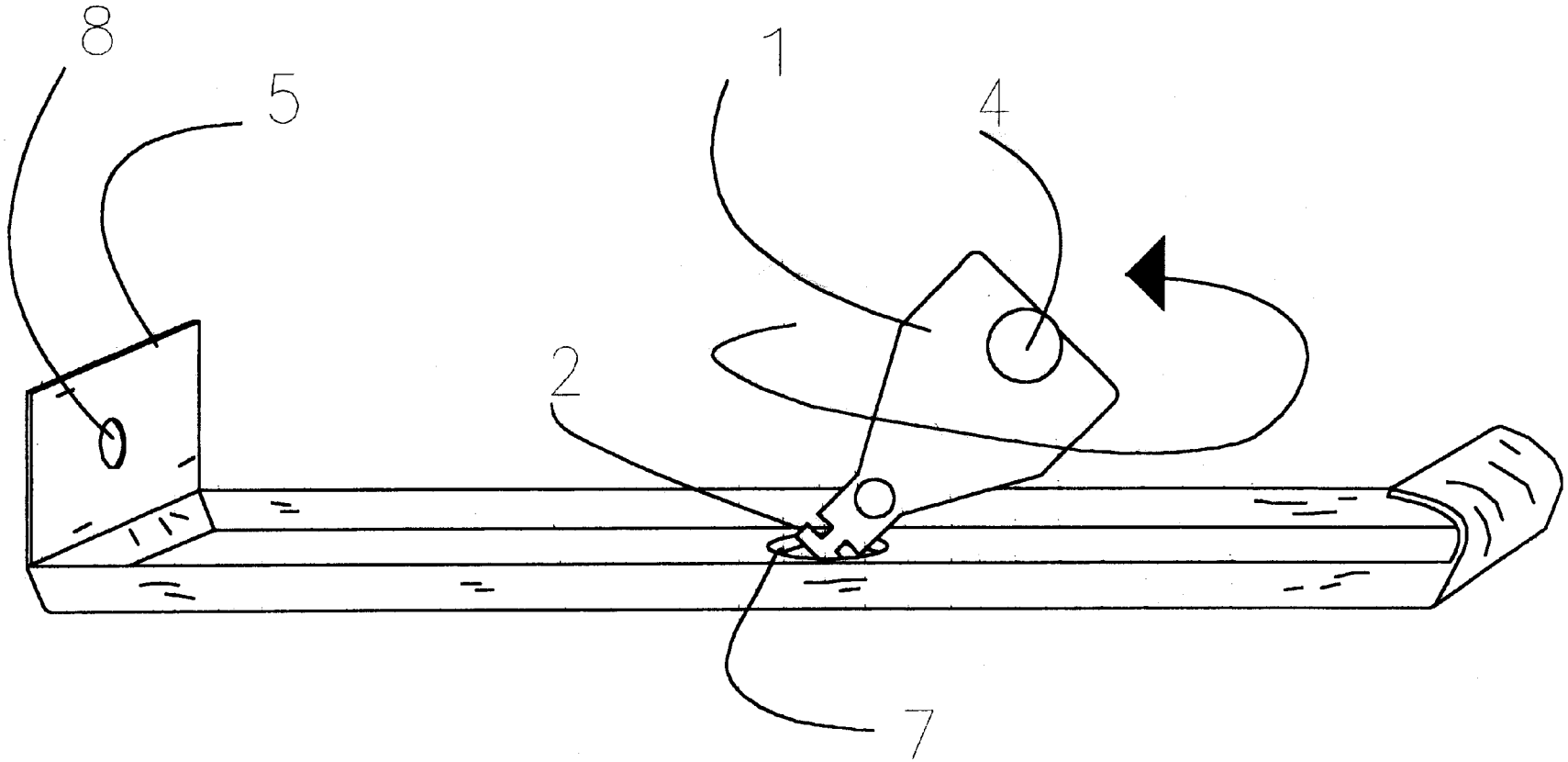
FIG. 2 is a perspective view of the supplemental gutter support bracket in relationship to the conventional gutter bracket as said supplemental support bracket is being installed upon said conventional support bracket.
Figure 3:
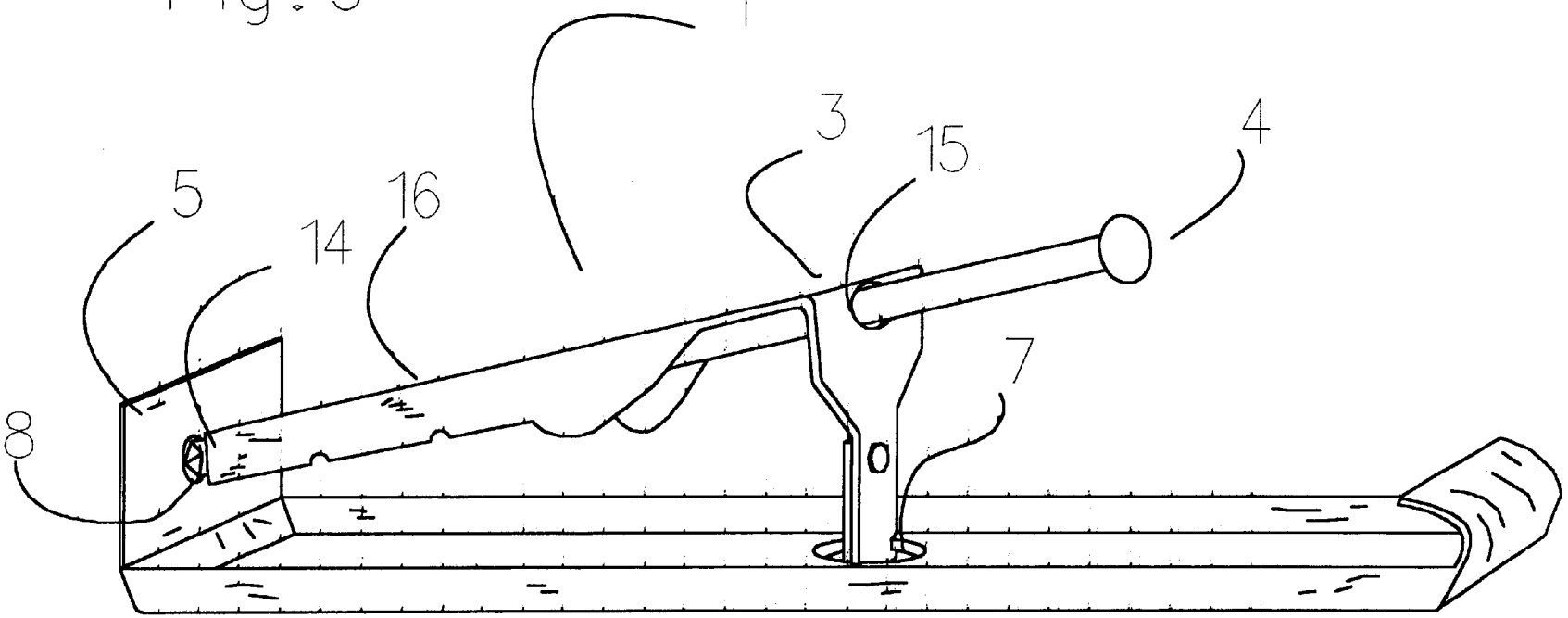
FIG. 3 is a perspective view of the supplemental gutter support bracket in relationship to the conventional gutter bracket as installed upon said conventional support bracket.
Figure 7:
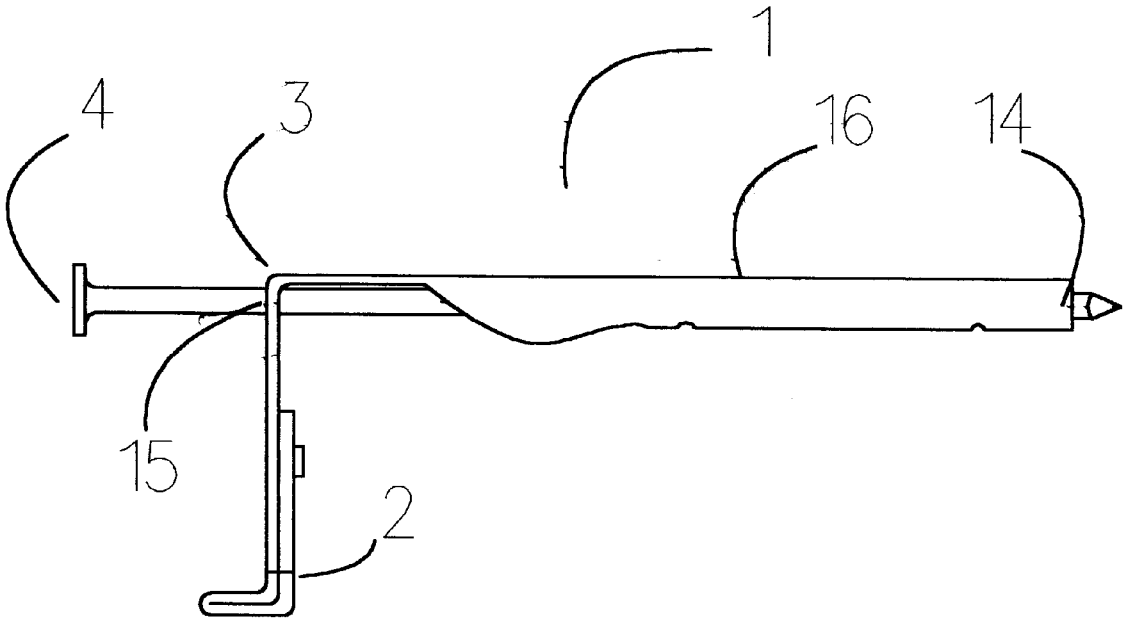
FIG. 7 is a side view of another preferred embodiment of the invention. This figure demonstrates a straight tab as the means to secure the rear portion of the supplemental gutter support bracket to the conventional gutter bracket.
Figure 8:
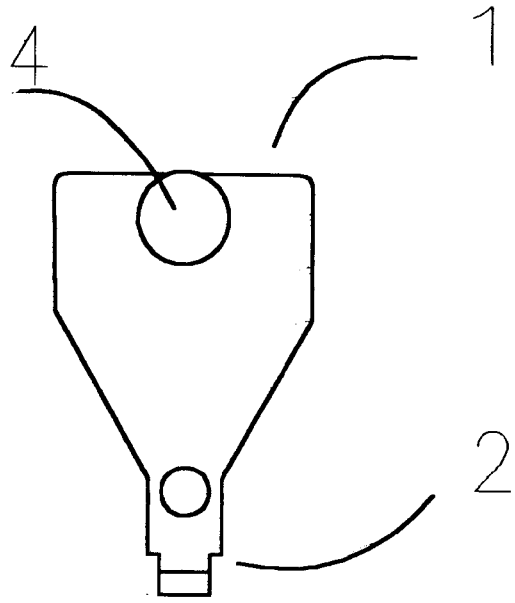
FIG. 8 is a rear view of the supplemental gutter support bracket which incorporates the straight tab.
Figure 9:
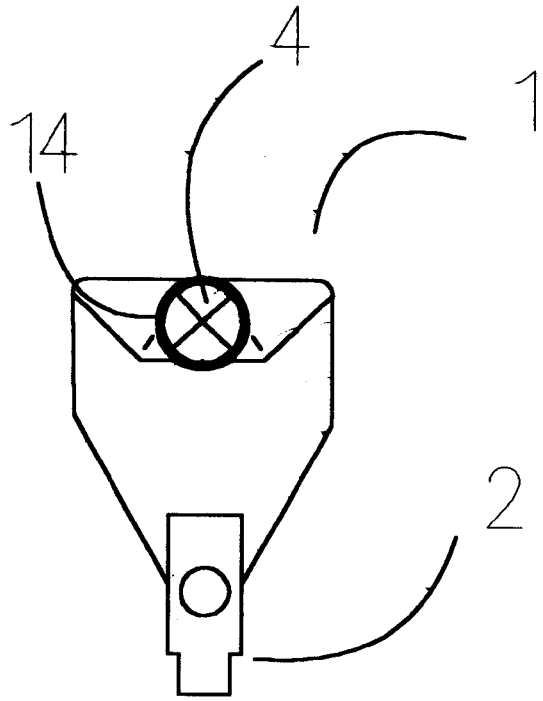
FIG. 9 is a frontal view of the supplemental gutter support bracket which incorporates the straight tab.

FIGS. 2 and 3 demonstrate how the supplemental gutter support bracket 1 is installed upon a conventional gutter bracket 5. The locking tab member 2 is inserted into the locking tab member slot 7 which is sized to accept the locking tab member 2 as long as the installed fastener 4 is perpendicular to the locking tab member slot 7. After insertion of the locking tab member 2 the entire supplemental gutter support bracket 1 is rotated until the tip of the fastener 4 becomes in contact with side of the conventional gutter bracket 5 the aperture 8. The fastener 4 can then be slightly pulled backward from the conventional gutter bracket aperture 8 thereby allowing the supplemental gutter support bracket 1 to be rotated until the flange portion 14 is in alignment with the conventional gutter bracket aperture 8. The entire unitary member consisting of the supplemental gutter support bracket 1 (with the pre-installed fastener 4 as set forth above) and the conventional gutter bracket 5 may then be installed as set forth above. Once again, installing another variation of the preferred embodiment (as shown in FIGS. 7, 8, and 9) would simply necessitate slidably inserting the locking tab member 2 into the locking tab member slot 7 without the need to rotate the entire supplemental gutter support bracket 1 as set forth above.

It should also be pointed out at this point that the supplemental gutter support bracket 1 may be installed upon a conventional gutter bracket 5 before or after the conventional gutter bracket 5 is installed. If the conventional gutter bracket 5 has been previously installed upon a gutter 10, the existing fastener located within the conventional gutter bracket aperture 8 must first be removed before installation of the supplemental gutter support bracket 1 can occur. With the flange portion 14 being in alignment with the conventional gutter bracket aperture 8 the fastener 4 can be driven through the flange portion 14, the conventional gutter bracket aperture 8, the gutter 10 (FIG. 4), and finally into the eave of the building 13 which is to receive the gutter 10.

If the conventional gutter bracket 5 is being installed for the first time upon a gutter, the supplemental gutter support bracket 1 may be installed upon the conventional gutter bracket 5 as shown above prior to the installation of the supplemental gutter support bracket/conventional gutter bracket assembly (collectively referred to as "assembly" and shown in FIG. 3). The assembly would then be installed in the same manner as a separate conventional gutter bracket 5 except for the fastener 4 would be utilized to secure the gutter system to the eave instead of a conventional type fastener. The fastener 4 shown is a nail type fastener, but could be easily be a screw or other such suitable fastening device.

Now referring to FIG. 4, in the event the supplemental gutter support bracket 1 is being installed upon a conventional gutter bracket 5 which has previously been installed upon an eave 13, the existing fastener located within the conventional gutter bracket aperture 8 must first be removed before installation of the supplemental gutter support bracket 1 can occur. Due to the angle of the fastener 4 as positioned within the supplemental gutter support bracket 1, the angle at which the fastener 4 penetrates the eave 13 is such that it allows the fastener 4 to penetrate a more secure portion of the eave 13 which was not penetrated by the prior installation of a fastener within the conventional gutter bracket aperture 8.

I claim:

1. A supplemental gutter support bracket utilized in connection with a conventional gutter bracket which is comprised of the following:

a body member having a barrel and a tab portion which is shaped in a manner to engage a tab aperture or slot of the conventional gutter bracket thereby providing further support to said conventional gutter bracket; a fastener, which includes a tip portion, slidably mounted within said barrel of said body member in a manner whereby said tip portion slidably extends through said barrel and then through an aligned aperture of said conventional gutter bracket thereby establishing a common point of attachment for affixing the combined conventional gutter bracket and said supplemental gutter support bracket upon a structure by further engaging said tip portion through said structure to receive a gutter.

2. The invention set forth in claim 1 where the fastener is further defined as a nail.

3. The invention set forth claim 1 where the fastener is further defined as a screw.

4. The invention set forth in claim 1 where the supplemental gutter support bracket is constructed from plastic.

5. The invention set forth in claim 1 where the supplemental gutter support bracket is constructed from aluminum.

6. The invention set forth in claim 1 where the supplemental gutter support bracket is constructed from steel.

7. The invention set forth in claim 1 where the fastener is frictionally preinstalled within the barrel during the manufacturing process by press fitting said fastener within said barrel after the supplemental gutter support bracket is formed.

* * * * *